US006385425B1

(12) United States Patent
Tanaka

(10) Patent No.: US 6,385,425 B1
(45) Date of Patent: May 7, 2002

(54) IMAGE FORMING APPARATUS AND METHOD HAVING A VARIABLE CONVEYING MODE IN AN IMAGE TRANSFER SECTION

(75) Inventor: Toshiaki Tanaka, Fukaya (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,742

(22) Filed: Sep. 26, 2000

(30) Foreign Application Priority Data

Sep. 29, 1999 (JP) ..... 11-275538

(51) Int. Cl.[7] ..... G03G 15/01; G03G 15/00
(52) U.S. Cl. ..... 399/299; 399/303; 399/401
(58) Field of Search ..... 399/298, 299, 399/303, 312, 313, 306, 401

(56) References Cited

U.S. PATENT DOCUMENTS 4,916,547 A 4/1990 Katsumata et al. ..... 358/300
5,132,721 A * 7/1992 Randall ..... 399/313 X
5,765,082 A * 6/1998 Numazu et al. ..... 399/299
5,995,717 A 11/1999 Tanaka ..... 347/116 X
6,061,542 A * 5/2000 Minami et al. ..... 399/299
6,108,510 A * 8/2000 Nakane ..... 399/303
6,192,207 B1 * 2/2001 Yamamoto et al. ..... 399/303 X
6,201,944 B1 * 3/2001 Onuki et al. ..... 399/299

FOREIGN PATENT DOCUMENTS

JP 10-161385 6/1998

* cited by examiner

*Primary Examiner*—Susan S. Y. Lee
(74) *Attorney, Agent, or Firm*—Foley & Lardner

(57) ABSTRACT

An image forming apparatus is provided with a plurality of image forming units that include a plurality of image carriers for forming developer images of different colors on an image transfer medium. The image forming apparatus also includes a transfer unit for conveying an image transfer medium to the plurality of image carriers, and an identification unit for identifying developer image forming units necessary for forming a predetermined image. The image forming apparatus further includes a switch unit for switching between a first contact state where the transfer means is brought into contact with a part of the plurality of image forming units and a second contact state where the transfer unit is brought into contact with all of the plurality of image forming units. The image forming apparatus still further includes a mode selection unit for selecting either one of a first transfer mode for transferring an image on only one side of the image transfer medium and a second transfer mode for transferring an image on both sides of the image transfer medium, and a control unit for controlling to set the contact state between the transfer unit and the plurality of developer image forming units to the second contact state.

17 Claims, 12 Drawing Sheets

IMAGE FORMING APPARATUS AND METHOD HAVING A VARIABLE CONVEYING MODE IN AN IMAGE TRANSFER SECTION

CROSS-REFERENCE TO RELATED APPLICATIONS

This application is based upon and claims the benefit of priority from the prior Japanese Patent Application No. 11-275538, filed September 29, the entire contents of which are incorporated herein by reference.

BACKGROUND OF THE INVENTION

The present invention relates to an image forming apparatus applied as a color printer apparatus or a color copying apparatus, as well as an image forming method.

An example of the image forming apparatus of the above-described type is a 4-series tandem type apparatus in which a plurality of electronic photographic process units are arranged to oppose to the same transfer belt.

These electronic photographic process units are arranged to have predetermined intervals therebetween along the direction in which sheets are conveyed, and the transfer belt is designed to swing in a swaying direction to be brought into contact with or away from the photosensitive drums of the respective electronic photographic process units in accordance with a printing mode. These plurality of photosensitive drums are used for colors of yellow, magenta, cyan and black.

In an image forming operation, when, for example, a full-color printing mode is designated, the transfer belt is tilted towards the photosensitive drums and is brought into rotation-contact with all of the photosensitive drums.

Sheets are fed from a feeder portion, and then each of them is aligned by a pair of aligning rollers, to be output to the transfer belt. A fed sheet is conveyed to each of the photosensitive drums one after another, and thus toner images of these colors are transferred on the sheet one on another.

When a black and white printing mode is designated, the transfer belt is tilted in an opposite direction to the case of the full-color mode, with respect to the rotation-contact section between the transfer belt and the photosensitive drum for black, situated at the lowermost stream in the sheet conveying direction, so as to separate it from each of the photosensitive drums for yellow, magenta and cyan. Therefore, the sheet conveying power of the transfer belt decreases. Therefore, a charger is provided below a sheet introduction side of the transfer belt so as to charge the transfer belt electrostatically by the charger. By means of the electrostatic charge, each sheet is attracted to the transfer belt so that it can be conveyed surely to the photosensitive drum for black.

Further, a press roller which is also brought into rotation-contact with the transfer belt is provided above the sheet introduction side of the transfer belt. With this structure, in the case of the black and white printing mode, a sheet is pressed against the transfer belt by the press roller, so as to assure the sheet to be appropriately conveyed.

However, conventionally, in the black and white mode, when the both-side printing mode is designated, a sheet printed on one side is inversed and then guided to the aligning roller pair. During this operation, a straight sheet is given a curling shape, and thus it is easily distorted that way at the inversion site, and as a result, the sheet is not completely or entirely attached to the transfer belt, creating a portion partially floating from the belt. If a sheet partially floats from the belt, it is likely to have a problem of the sheet being stuck on the photosensitive drum, which causes the increasing of the occurrence rate of paper jam.

Meanwhile, an upper guide plate and a lower guide plate for guiding sheets are provided between the aligning roller pair and the press roller. Further, there is a difference between the feeding speed for sheets fed from feeder means and the conveying speed for sheets conveyed by the transfer belt, and due to this difference in speed, a sheet is deformed to have a warp. The warp deformation of the sheet is imparted within a space defined by the aligning roller pair, the press roller and the upper and lower guide plates.

However, with regard to a small-sized color printer or color copying machine, there is a limitation to the size of the device, and the distance between the aligning roller pair and the transfer belt cannot be designed wide. As a result, in the conventional cases, the press roller is situated always at the same position and projects in the space, regardless of the type of the printing mode, and the space is reduced in size, which easily causes the problem of paper jam.

BRIEF SUMMARY OF THE INVENTION

The present invention has been achieved in consideration of the above-described circumstances, and the object thereof is to provide an image forming apparatus capable of accurately conveying an image transfer medium material without having jamming of the image transfer medium material by varying the conveying mode of the image transfer section for the object material in accordance with the image forming state of the object material fed to the transfer section, and capable of having a design in which a large space can be prepared for the object material to warp, as well as such an image forming method.

According to the present invention, there is provided an image forming apparatus comprising a plurality of image forming means for forming developer images of different colors, transfer means for conveying an image transfer medium to the image carriers of the plurality of image forming means, and transferring the developer images formed by the plurality of developer image forming means on the image transfer medium, identification means for identifying developer image forming means necessary for forming a predetermined image, switch means for switching, in accordance with an identification result of the identification means, between a first contact state where the transfer means is brought into contact with a part of the plurality of developer image forming means and a second contact state where the transfer means is brought into contact with all of the plurality of developer image forming means, mode selection means for selecting either one of a first transfer mode for transferring an image on only one side of the image transfer medium, and a second transfer mode for transferring an image on both sides of the image transfer medium, and control means for controlling to set the contact state between the transfer means and the plurality of developer image forming means to the second contact state regardless of the identification result of the identification means in the case where the mode designated by the mode selection means is the second transfer mode.

Further, according to the present invention, there is provided an image forming apparatus comprising a plurality of image forming units for forming images on image carriers, a transfer unit for conveying an image transfer medium to the image carriers of the plurality of image forming units, and transferring the images on the image carriers on one surface side of the image transfer medium, a feeder unit for feeding the image transfer medium to the transfer unit, a contact-separation mechanism for bringing the transfer unit in contact with all of the plurality of image forming units in a multi-color image forming mode, and for bringing the transfer unit in contact with image carrier of some of the plurality of image forming units, in a monochrome image forming mode, a judgment unit for judging whether or not an image is formed on an other surface side of the image transfer medium fed to the feeder unit, and a control unit for controlling an operation of the contact-separation mechanism such as to bring the transfer unit into contact with all of the image carriers of the plurality of image forming units when the judgment unit judges that an image is formed on the other surface side of the image transfer medium in a single color image forming mode.

Furthermore, according to the present invention, there is provided an image forming method of an image forming apparatus having a plurality of image forming means for forming developer images of different colors, and transfer means for transferring the developer images formed by the plurality of developer image forming means on the image transfer medium, the method comprising a first identification step for identifying if a mode is for forming a multi-color image or a monochrome image, a second identification means for identifying a first transfer mode where an image is transferred on only one side of the image transfer medium or a second transfer mode where an image is transferred on both sides of the image transfer medium a switching step for switching, in accordance with identification results of the first and second identification means, contact states between the transfer means and the plurality of developer image forming means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described in detail with reference to accompanying drawings.

Figure 1:
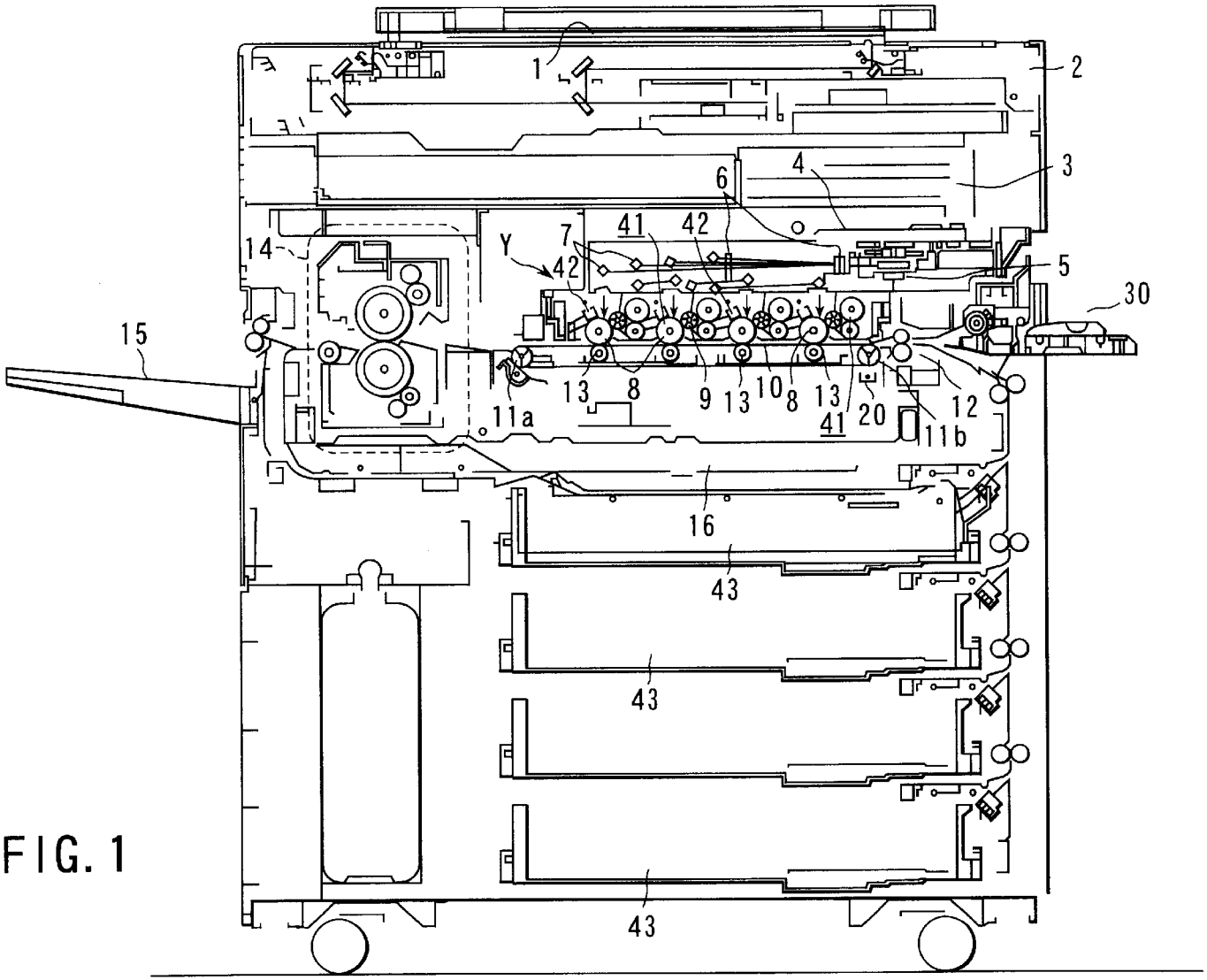
FIG. 1 is a schematic diagram showing the structure of the color electrophotographic copying device according to an embodiment of the present invention.

FIG. 1 is a schematic diagram showing the structure of a full-color copying machine, as the color electrophotographic copying device according to an embodiment of the present invention. The full-color copying machine is of a 4-series tandem type in which a plurality of electrophotographic process units are arranged to oppose to the same transfer belt.

An original placement table 1 on which an original sheet is placed, is provided on an upper surface portion of the full-color copying machine, and a scanner 2 for reading image data on the original sheet placed on the original placement table 1 is provided in an lower section of the original placement table 1. Underneath the scanner 2, there is provided an image data processing circuit 3 for reading data from an external device such as a computer, and storing the data in an image memory, then processing the data.

Underneath the image data processing circuit 3, an exposure device 4 such as a laser beam generating device for each color is provided. The exposure device 4 includes a laser beam generator, a polygon mirror 5 which reflects a beam generated by the laser generator, for scanning, an fθ lens 6 for correcting a focal point, and a reflection mirror 7 for reflecting a beam for scanning.

Meanwhile, a plurality of image forming units 41 which constitute an image forming section are provided along a sheet conveying direction, underneath the exposure device 4.

Each of these plurality of image forming units 41 includes a respective photosensitive drum 8 serving as an image carrier, and a developer unit 9 is disposed to face the respective one of the photosensitive drums 8. In a developer unit 9 of the image forming unit 41 which is situated at the uppermost stream side in the sheet conveying direction, a developer of yellow color (Y) is contained. Further, developer units 9 of the image forming units 41 which are arranged in the order towards the downstream side in the sheet conveying direction, toners of magenta color (M), cyan color (C) and black color (B) are respectively contained. A transfer belt 10 which constitutes a transfer unit is brought into rotation-contact with the lower sides of the photosensitive drums 8 of these image forming units 41. The transfer belt 10 is crossed over between a driver roller 11*a* and a driven roller 11*b*.

On the inner surface side of the transfer belt 10, a transfer roller 13 for transferring a toner image on the photosensitive drums 8 onto a sheet, is provided. It should be noted that the photosensitive drums 8 and the transfer belt 10 move in a rotate-contact state at the same circumferential speed, and therefore a toner image can be transferred onto a sheet without being drifted or blurred.

An aligning mechanism unit 12 for aligning a sheet by setting its leading end to abut thereto, and then feeding the sheet to the transfer belt 10 is provided on the sheet introduction side of the transfer belt 10. On the downstream side of the transfer belt 8 in the sheet conveying direction, a fixing unit 14 and a fed-out tray 15 for receiving a fed-out sheet are provided.

Underneath the transfer belt 8, a both-side printing unit 16 is provided, and in this unit, in the case of the both-side printing mode, a sheet whose one side is printed by the fixing unit 14 is introduced via a gate, and inverted here to be guided again to the aligning mechanism unit 12.

In order to form an image, for example, in the case of the color printing mode (note that in this mode, the transfer belt 10 is in a rotation-contact state with respect to all of the photosensitive drums 8 as will be described later), image data on an original sheet placed on the original placement table 1 is read by means of an image reading scanner 2, or data is read from an external device such as a computer, and then the data is stored in the image memory. After that, the image data is processed by the image data processing circuit 3. The image data proceed for each color in the image data processing circuit 3, is sent to the exposure units 4 such as the laser beam generating units for those colors under the control of the image forming timing control circuit. In this manner, a beam is generated from the baser generator of each of the exposure units 4. The beam is applied onto the polygon mirror 5, where it is reflected, and as the polygon mirror 5 is rotated, scanning is performed. The scanning beam is focus-corrected by the fθ lens 6 and the optical path of the beam is changed by the reflection mirror 7. In this manner, the beam is guided to each of the photosensitive drums 8.

The circumferential surface of each of the photosensitive drums 8 is charged uniformly at a predetermined potential by a charger 42, and as the beam scans on the charged circumferential surface, an electrostatic latent image is formed. The electrostatic latent images on these drums are sent to the developer units 9 as each of the photosensitive drums 8 rotates. Thus, toner is supplied from the developer units 9 to the latent images, and toner images of these colors are formed.

In the meantime, a sheet is fed from a paper feeder cassette 43 serving as a paper feeding unit, and the sheet is aligned by the aligning mechanism 12, then sent out to the transfer belt 8. The sheet sent to the transfer belt 8 is conveyed to the photosensitive drums 8, where a toner image is transferred from each of the photosensitive drums 8 one after another, thus forming a color image on the sheet. The sheet on which the toner image has been transferred is guided to the fixing unit 14, where the sheet is heated and pressed so as to fix the image thereon. After the fixing of the image, the sheet is fed out to the fed-out tray 15.

In the case of the black and white printing mode (note that in this mode, the transfer belt 10 is in a rotation-contact state with respect to only the photosensitive drum 8 which is situated on the most downstream side in the sheet conveying direction as will be described later), a toner image of black color is formed on the photosensitive drum 8 which is situated on the most downstream side in the sheet conveying direction, and the toner image is transferred onto the sheet. The sheet on which the toner image has been transferred is guided to the fixing unit 14, where the sheet is heated and pressed so as to fix the image thereon. After the fixing of the image, the sheet is fed out to the fed-out tray 15.

Further, in either case of the color printing and black and white printing modes, when the both-side printing mode is selected, the sheet on one side of which the image has been fixed by the fixing unit 14 is introduced to the both-side printing unit 16 via a gate. The sheet is inverted by the both-side printing unit 16, and sent back to the aligning mechanism 12. After while, a toner image is transferred on the opposite surface of the sheet in a similar manner to the above. Then, after the transfer of the image, the toner image is fixed and the sheet is fed out.

Figure 2:
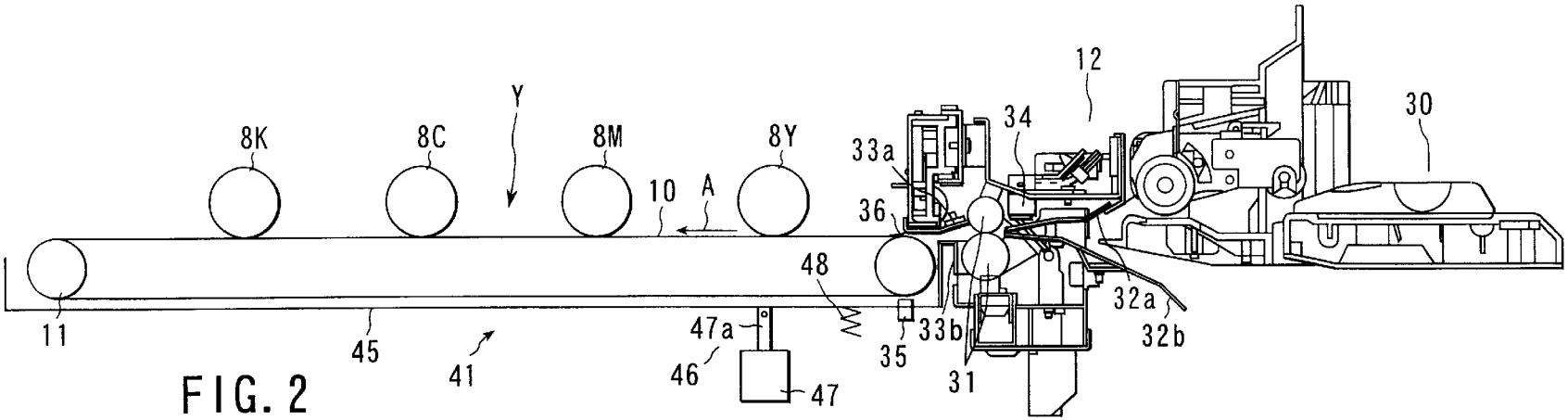
FIG. 2 is a diagram showing the state of the transfer belt in the color printing mode.
Figure 3:
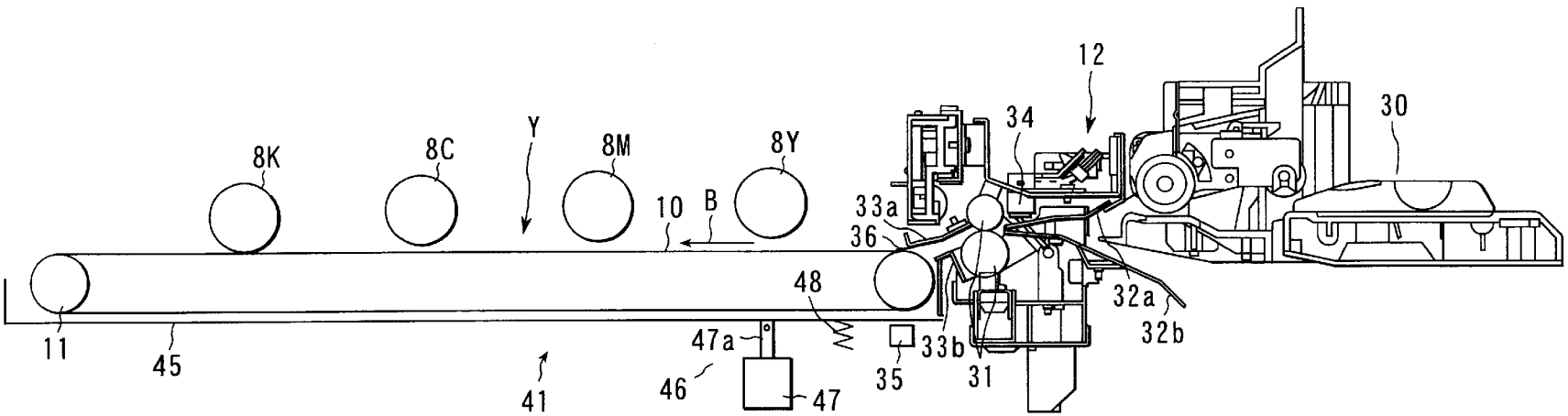
FIG. 3 is a diagram showing the state of the transfer belt in the black and white color printing mode.

FIGS. 2 and 3 are diagram showing enlarged views of a manual paper feeding unit 30, an aligning roller mechanism 12, a plurality of photosensitive drums 8Y to 8K and a transfer belt 10. FIG. 22 shows the state of the transfer belt 10 in the color printing mode, and FIG. 23 shows the state of the transfer belt 10 in the black and white (monochrome) printing mode.

The aligning mechanism 12 has a pair of aligning rollers 31 which are in rotation-contact with each other, and to one of the aligning roller pair 31, a driving motor which is not shown is coupled. Between the aligning roller pair 31 and the manual feeder unit 30, upper and lower guide plates 32*a* and 32*b* on the feed-in side, are provided, whereas between the aligning roller pair 31 and the transfer belt 10, upper and lower guide plates 33*a* and 33*b* on the feed-out side, are provided. At a position close to the feed-in side upper guide plate 32*a*, an OHP sheet identifying sensor 34 is disposed. With this sensor, when a medium passing through the aligning mechanism 12 is an OHP sheet, it is detected so and a signal is outputted.

In the image forming apparatus of this embodiment, the designation unit 53 made of a control panel and the like, which will be later explained, is operated by the user so as to designate the color printing mode or black and white printing mode with use of the designation unit. On the basis of the mode designated by the user, the CPU 51, which will be later explained, identifies image forming means which contains a developer necessary for forming the image. That is, when the color printing mode is designated, it is judged that the image must be formed with use of developers of yellow, magenta, cyan and black supplied to the respective photosensitive drums 8Y, 8M, 8C and 8K. On the other hand, when the black and white printing mode is designated, it is judged that the image must be formed using the developer of black onto the photosensitive drum 8K only. The CPU 51 operates to move the transfer belt 10 on the basis of the designated mode shown in FIG. 2 or 3 so that a developer image of a desired color will be formed. Needles to say, it is also possible to automatically judge which of the color printing and black and white mode should be selected from the content of an original sheet read by a scanner or the like in pre-scanning, without user's instruction.

In the color printing mode shown in FIG. 2, the transfer belt 10 is brought into rotation-contact with all of the photosensitive drums 8, and with this structure, a sheet fed from the aligning mechanism 12 is guided to the photosensitive drums 8 one after another.

In the black and white printing mode shown in FIG. 3, the transfer belt 10 is moved obliquely downwards with respect to the rotation contact point between the black photosensitive drum 8K and the transfer belt 10, taken as its fulcrum, and thus it is separated from the photosensitive drums 8Y, 8M and 8C. In this state, a sheet fed from the aligning mechanism 12 is guided directly to the rotation contact point between the black-color photosensitive drum 8K situated at the most downstream side in the sheet conveying direction, and the transfer belt 10.

Underneath the sheet introducing side of the transfer belt 10, a charger 35 for charging the transfer belt 10 with static electricity in advance in the black and white printing mode, is provided. Further, above the sheet introducing side of the transfer belt 10, a pressing sheet 36 serving as pressing member, which is smooth over its entire surface and has an elasticity, is provided. The pressing sheet 36, in both cases shown in FIG. 2 for the color printing mode and FIG. 3 for the black and white printing mode, is brought into rotation-contact with the transfer belt 10 elastically at all times, and in this manner, a sheet is pressed forcibly thereto.

Therefore, even in the state where the photosensitive drums 8Y, 8M and 8C, other than the photosensitive drum 8K for black color, are separated from the transfer belt 10, the sheet is attached electrostatically to the transfer belt 10, and therefore it can be surely conveyed.

It should be noted that the pressing sheet 36 is used in place of an attachment sheet conventionally used, and the space surrounded by the aligning roller pair 31, the pressing sheet 36 and the upper and lower guide plates 33*a* and 33*b* becomes a space in which a sheet can warp.

With the above-described structure, the occupying space taken by the attachment roller protruding to the space for the warping of sheets, is reduced to about ¼ of the conventional cases by replacing the conventional attachment roller with the attachment sheet 36. In this manner, the sheet warping space S is enlarged, and therefore the occurrence of sheet jamming can be prevented.

Further, the pressing sheet 36 is made of an elastic material and it elastically presses the sheet against the transfer belt 10; therefore the vibration of the sheet, which occurs when it separates therefrom, can be made less. Therefore, the image jitter deterioration can be effectively reduced.

It should be noted that the transfer belt 10 is designed to swing in the up and down direction with respect to the rotation contact portion between the transfer belt 10 itself and the photosensitive drum 8K situated at the most downstream side in the sheet conveying direction by the driving mechanism 41 serving as a contact-separate mechanism.

The driving mechanism 41 has a mount frame 45 for mounting the transfer belt 10, and one end side of the mount frame 45 is rotatably supported by a support shaft which is not shown.

On the other end side of the mount frame 45, an ascending/descending mechanism 46 is provided. The ascending/descending mechanism 46 has an electromagnetic solenoid 47, and the electromagnetic solenoid 47 has an actuator 47*a,* an upper end portion of which is connected to the mount frame 45. The other end portion side of the mount frame 4 is urged upwards by a spring 48.

When the electromagnetic solenoid 47 is demagnetized, the other end side of the mount frame 45 is lift up by the urging force of the spring 48. Consequently, the mount frame 42 is pivoted upwards with respect to the support shaft as the center, and in this manner, the transfer belt 10 is brought into rotation-contact with all of the photosensitive drums 8Y to 8K. When the electromagnetic solenoid 45 is activated to be magnetized, the mount frame 42 is moved obliquely downwards with respect to the support shaft as the center against the urging force of the spring 48. In this manner, the transfer belt 10 is separated from the other photosensitive drums 8Y to 8C than the photosensitive drum 8K.

It should be noted here that the contact-separation operation of the transfer belt 10 is carried out with use of an electric motor 71 which rotates in clockwise and counter-clockwise directions, in place of the electromagnetic solenoid 47.

In this case, a screw gear 72 is mounted on the rotation shaft of the electric motor 71, and a rack 73 is engaged with the screw gear 72. With the rack 73, a tooth section 75 formed in the lower end portion of a pivotal lever 74 is engaged. The pivotal lever 74 is designed to pivot with respect to the support shaft 76. A press spring 77 is mounted to the pivotal lever 74, and when the transfer belt 10 is pushed above with the pivotal lever 74 by means of the press spring 77, such a state is elastically maintained.

When the electric motor 71 is rotated in the clockwise direction, the screw gear 72 is rotated such as to move the rack 73 in a direction indicated by arrow a. Accordingly, the pivotal lever 74 is pivoted in the clockwise direction, thus pushing the transfer belt 10 upwards.

When the electric motor 71 is rotated in the counter-clockwise direction, the screw gear 72 is rotated in an opposite direction such as to move the rack 73 in a direction indicated by arrow b. Accordingly, the pivotal lever 74 is pivoted in the counter-clockwise direction, thus pushing the transfer belt 10 downwards.

Figure 7:
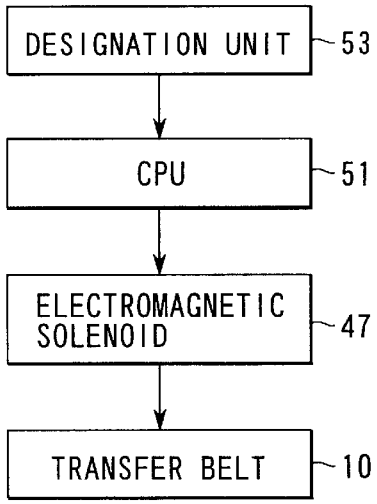
FIG. 7 is a block diagram showing a drive control system which swings the transfer belt.

FIG. 7 is a block diagram showing the control system of the driving mechanism 41.

As shown, to the electromagnetic solenoid 47 of the driving mechanism 47, a CPU 51 serving as a control unit is connected via a control circuit, and a designation unit 53 provided in the control panel is connected to the CPU 51. The designation unit 53 is designed to designate an image forming mode, for example, the color image forming mode or black and white image forming mode.

When the color image forming mode is designated with the designation unit 53, the CPU 51 operates to demagnetize the electromagnetic solenoid 47 of the driving mechanism 41, and when the black and white image forming mode is designated, the electromagnetic solenoid 47 is deactivated to be demagnetized.

When the black and white image forming mode is designated with the designation unit 53 and the both-side copy mode is designated, the CPU 51 operates to proceed the followings. That is, when an image has been copied on one side of a sheet, the electromagnetic solenoid 47 of the driving mechanism is demagnetized so as to bring the transfer belt 10 into contact with all of the photosensitive drums 8Y to 8K.

Figure 4:
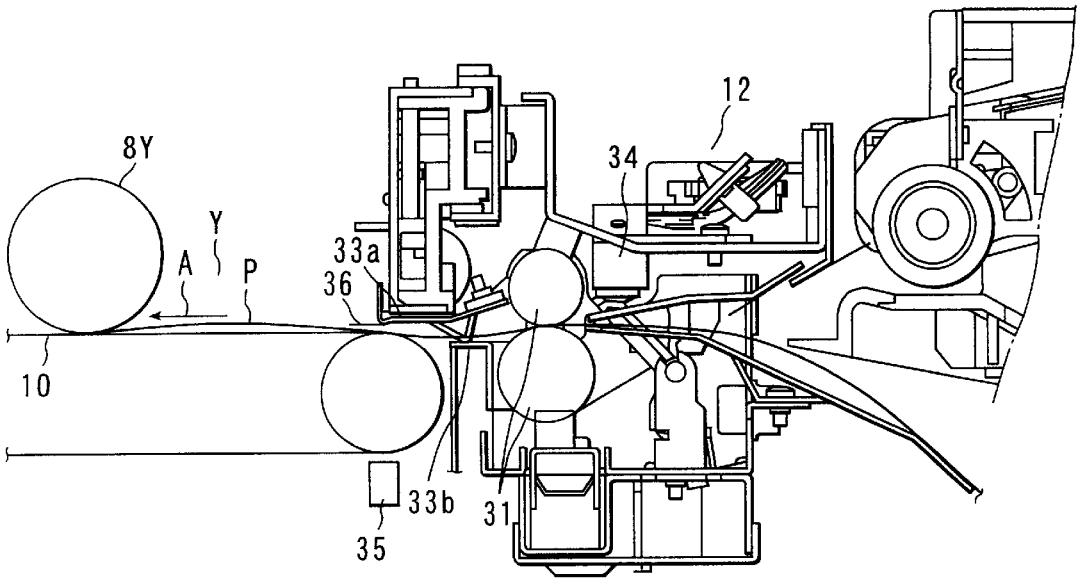
FIG. 4 is a diagram showing an enlarged view of the state of conveying a sheet in the color printing mode.
Figure 5:
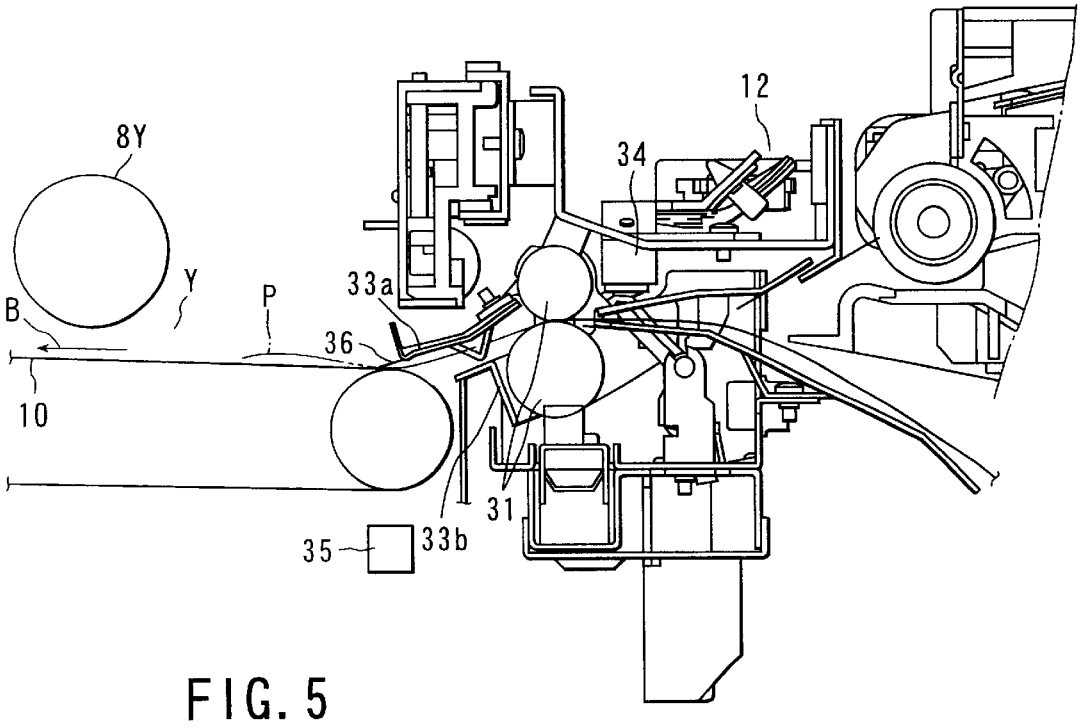
FIG. 5 is a diagram showing an enlarged view of the state of conveying a sheet in the black and white printing mode.

FIGS. 4 and 5 are diagrams showing enlarged views of the aligning mechanism 12 and the most upstream portion of the transfer belt 10 in the sheet conveying direction.

Further, FIG. 4 shows the state in which a sheet P is conveyed in the case where the color printing mode is designated, whereas FIG. 5 shows the state in which a sheet P is conveyed in the case where the black and white printing mode is designated.

In the color printing mode shown in FIG. 4, a sheet P fed out from the aligning roller pair 31 is elastically pressed onto the transfer belt 10 by the pressing sheet 35. During this period, the charger 35 does not operates, and therefore the transfer belt 10 is not electrostatically charged.

Further, in the color printing mode, the transfer belt 10 is moved obliquely upwards to be brought into rotation-contact with all of the photosensitive drums 8Y to 8K. With this structure, the distance from the pressing site of the pressing sheet 36 to the rotation-contact point between the photosensitive drum 8Y located at the most upstream side, and the transfer belt 10 is very small. Therefore, even if the elastic force of the pressing sheet 36 is weak and the pressing function becomes insufficient, the top end of the sheet P is not excessively curled and therefore the sheet is appropriately interposed smoothly at the rotation contact point, thus preventing the jamming of the paper.

In the black and white printing mode shown in FIG. 5, a sheet P fed out from the aligning roller pair 31 is elastically pressed onto the transfer belt 10 by the pressing sheet 35. During this period, the charger 35 for attracting sheets, operates, and therefore the transfer belt 10 is electrostatically charged. Thus, the sheet P is conveyed by the transfer belt 10 while being tightly attached thereto, and an image is formed directly onto the sheet by the photosensitive drum 8K located at the most downstream side, thus suppressing the possibility of the paper jamming.

Here, it should be noted that the both-side printing may be designated in the black and white printing mode. In this case, the sheet P on one side of which an image is printed as described above, is guided to the both-side printing unit 16 via the fixing device 14. The sheet guided to the printing unit 16 is inverted and conveyed, then fed again to the transfer belt 10 via the aligning mechanism 12. The sheet fed to the transfer belt 10 is conveyed to the black-color photosensitive drum 8K, where an image is transferred onto the other surface side, thus finishing the both-side printing. In this both-side printing mode, each sheet is forcibly inverted in the both-side printing unit 16, and therefore a curling deformation is imparted to each sheet. This curly deformation of the sheet is not straightened completely by the pressing force of the pressing sheet 36 while the sheet is passing through the aligning mechanism 12, and therefore each sheet is guided to the transfer belt 10 and conveyed in such a state that upward wavy deformation partially remains in the sheet. When the sheet is conveyed in such a state that upward wavy deformation partially remains in the sheet, it is likely to be stuck between the third photosensitive drum 8C and the transfer belt 10, where the gap is narrowest, thus creating the problem of paper jamming.

Therefore, according to the present invention, in the case of the black and white printing mode, when the both-side printing mode is designated with the designation unit 53, the transfer belt 10 is moved obliquely upwards to be brought into rotation-contact with all of the photosensitive drums 8Y to 8K as shown in FIG. 4. With this structure, the distance from the pressing site of the pressing sheet 36 to the rotation-contact point between the photosensitive drum 8Y located at the most upstream side, and the transfer belt 10 is very small. Therefore, even if the sheet is curly deformed and the pressing function of the pressing sheet 36 becomes insufficient, the sheet P is appropriately interposed smoothly at the rotation contact point between the drums and belt and conveyed by the photosensitive drums 8Y to 8K and the transfer belt 10, thus preventing the jamming of the paper.

Figure 6:
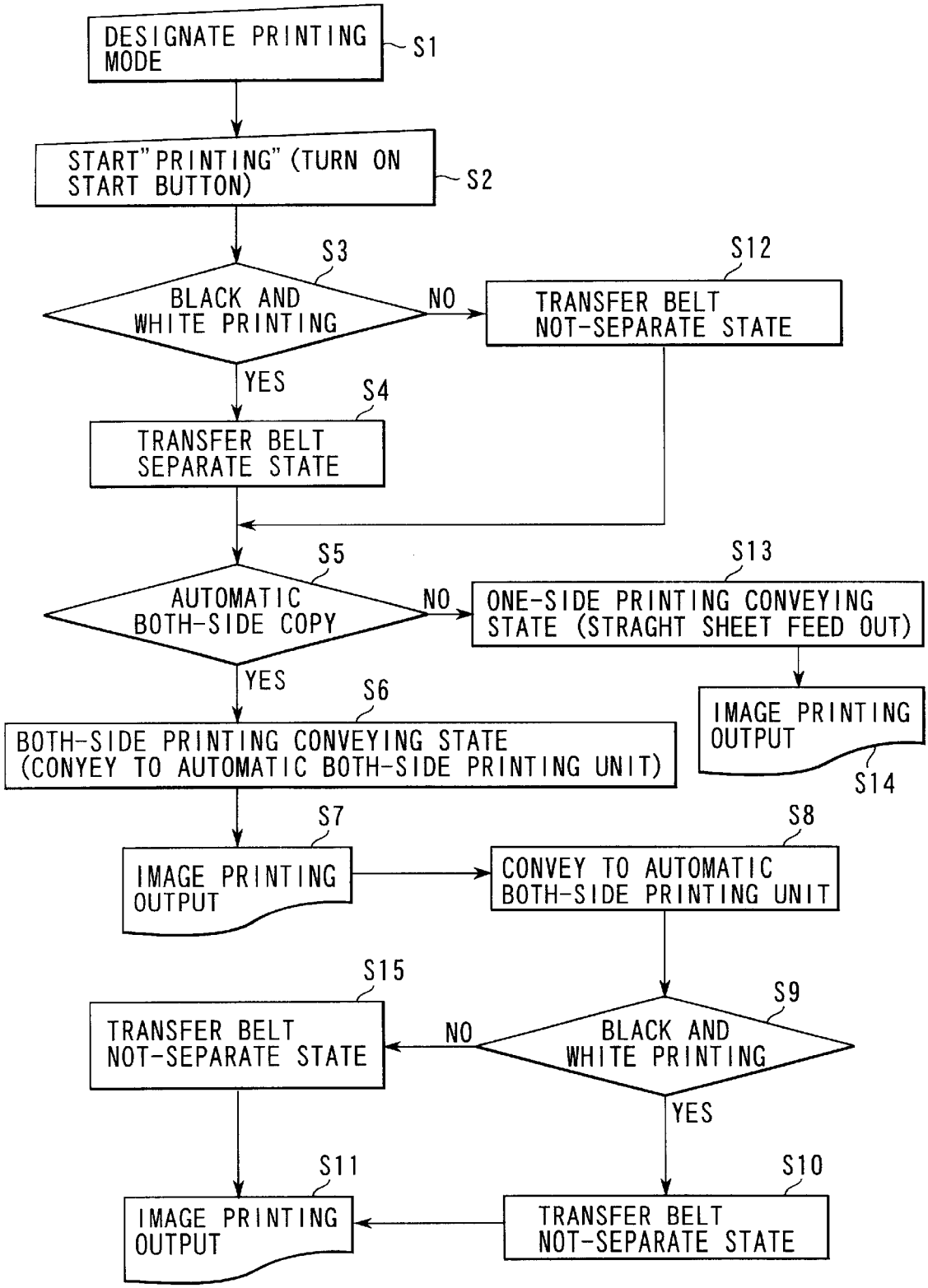
FIG. 6 is a flowchart illustrating the printing operation.

FIG. 6 shows the contact and separating motion of the transfer belt 10 with respect to the photosensitive drums 8Y to 8C, which is operated in compliance with the designation of a printing mode.

When a printing mode is designated by the designation unit 53 (step S1), and then a start button (not shown) is turned on to start a printing (step S2), it is detected by the CPU 51 whether or not the printing is in the black and white printing mode (step S3). When it is judged to be a black and white printing, the electromagnetic solenoid 47 is excited, and therefore the transfer belt 10 is moved obliquely downwards to be separated from the photosensitive drums 8Y to 8C (step S4). Subsequently, it is judged whether or not the printing is in the automatic both-side copy mode (step S5), and when it is judged to be an automatic both-side copy, a sheet is conveyed to the photosensitive drum 8K (step S6), and a black-color image is printed on one side of the sheet (step S7). After a while, the sheet is conveyed to the automatic both-side printing unit 16 (step S8). Then, it is detected whether or not the printing is in the black and white printing mode (step S9). When it is judged to be a black and white printing, the CPU 51 instructs that the electromagnetic solenoid 47 is excited, and therefore the transfer belt 10 is moved obliquely upwards to be brought into rotation-contact with all of the photosensitive drums 8Y to 8C (step S10). The inverted sheet is sent to the photosensitive drum 8K, with which a black and white image is printed (step 11).

Alternatively, when it is judged that the printing is not in a black and white printing mode, the electromagnetic solenoid 47 is demagnetized, and therefore the transfer belt 10 is moved obliquely upwards by the urging force of the spring 48 to be brought into rotation-contact with all of the photosensitive drums 8Y to 8C (step S12). After a while, the operations from the step S5 onwards are carried out.

Further, when it is judged in the step S5 that the printing is not of an automatic both-side copying operation, the conveying path for the one-side printing is taken (step S13), and a color image is printed on one side of the sheet (step S14).

Further, when it is judged in the step S9 that the it is not a black and white printing, the transfer belt 10 is brought into rotation-contact with all of the photosensitive drums (step S15), and the operation of the step S11 is carried out.

It should be noted here that the above-described switching operation for the transfer belt 10 is applied not only in the designation of the both-side printing in the black and white printing mode, but also in the case where it is forcibly selected manually.

As described above, in the case of a both-side copying mode in a single color, and when copying on one side is finished and the sheet is turned over to carry out copying on the other side, the transfer belt 10 is moved obliquely upwards to be brought into rotation-contact with all of the photosensitive drums 8Y to 8K. With this structure, the distance from the pressing site of the pressing sheet 36 to the rotation-contact point between the photosensitive drum 8Y and the transfer belt 10 can be made very small. Therefore, the top end of the sheet P is not excessively curled and therefore the sheet is appropriately interposed smoothly at the rotation contact point, thus preventing the jamming of the paper.

Further, the pressing member for pressing a fed paper sheet P against the transfer belt 10 is made to have a sheet-like structure, and therefore the pressing member will not protrude into the space between the aligning roller pair 31 and the sheet introduction side of the transfer belt 10.

Consequently, the space is not narrowed by the pressing member, and therefore the warping of a sheet within the space is never disturbed, thus making it possible to certainly prevent the paper jam.

Figure 8:
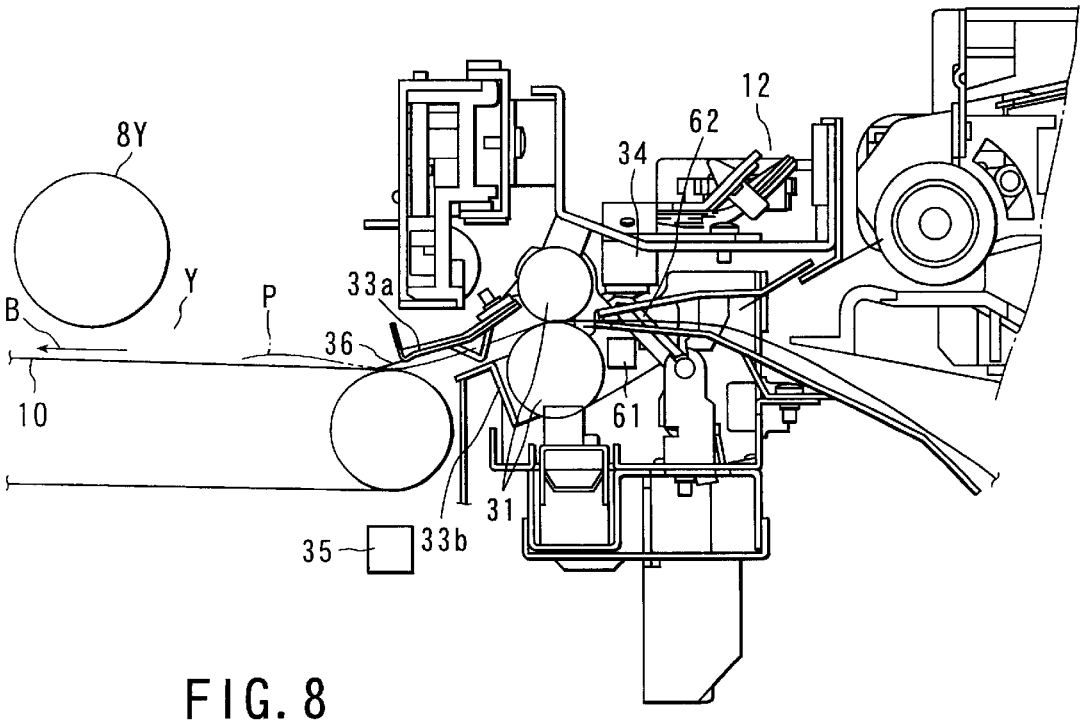
FIG. 8 is a diagram showing an enlarged view of a part of the color electrophotographic copying device according to another embodiment of the present invention.
Figure 9:
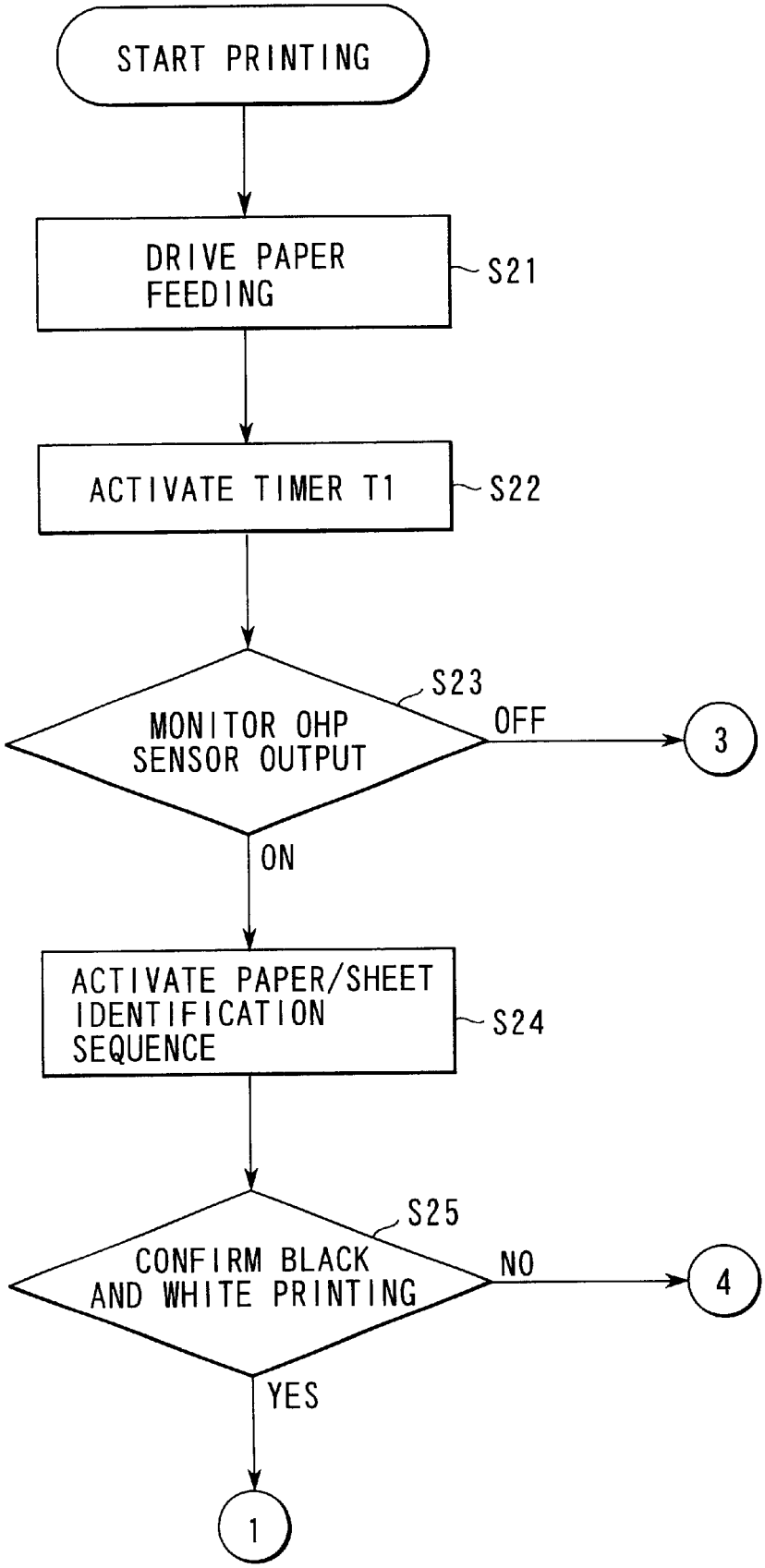
FIG. 9 is a flowchart illustrating a printing operation.

FIG. 8 shows another embodiment of the present invention.

Similar structural elements to those already described in the above embodiment will be designated by the same reference numerals and the explanations therefor will not be repeated.

In this embodiment, a detection sensor 61 which constitutes a judgment unit is provided at substantially a center position of the object material introducing side of the aligning roller pair 31 in its width direction. The detection sensor 61 is situated underneath an OHP sensor 34, and is designed to detect an image formed on a rear surface side of an image-transfer object material. As the detection sensor 61, for example, a reflection-type optical sensor for outputting an analog signal as to whether or not there is an image, or an imaging element (C-MOS type) for notifying with illumination of an LED element is used.

The detection sensor 61 monitors the image-transfer object material as to whether or not an image is formed on its rear surface side until the object material reaches the aligning roller 31.

According to this embodiment, in the case of the one-side black and white printing mode, when it is detected by the detection sensor 61 that an image is formed on the rear surface side of the object material, the rotation of the aligning roller 31 is stopped, and at the same time, the entire paper feeding system is stopped, thus setting a re-start stand-by state. Further, the transfer belt 10 is moved obliquely upwards from this state, to be brought into contact with all of the photosensitive drums 8Y to 8K. After making contacts, the drive of the aligning roller 31 and the entire paper feeding system are re-started, and paper sheets are thus fed.

It should be noted here that unless it is confirmed that there is no image detected on the rear surfaces of fed sheets by a predetermined number of sheets in a row (for example, continuously 5 sheets), the transfer belt 10 is maintained in contact with all of the photosensitive drums 8Y to 8K, so as to continue the black and white printing. In this manner, the wasteful switching time for the contact and separation motion of the transfer belt 10, which may occur, can be omitted for saving time.

FIGS. 9 to 14 are flowchart illustrating printing operations of this embodiment.

Figure 10:
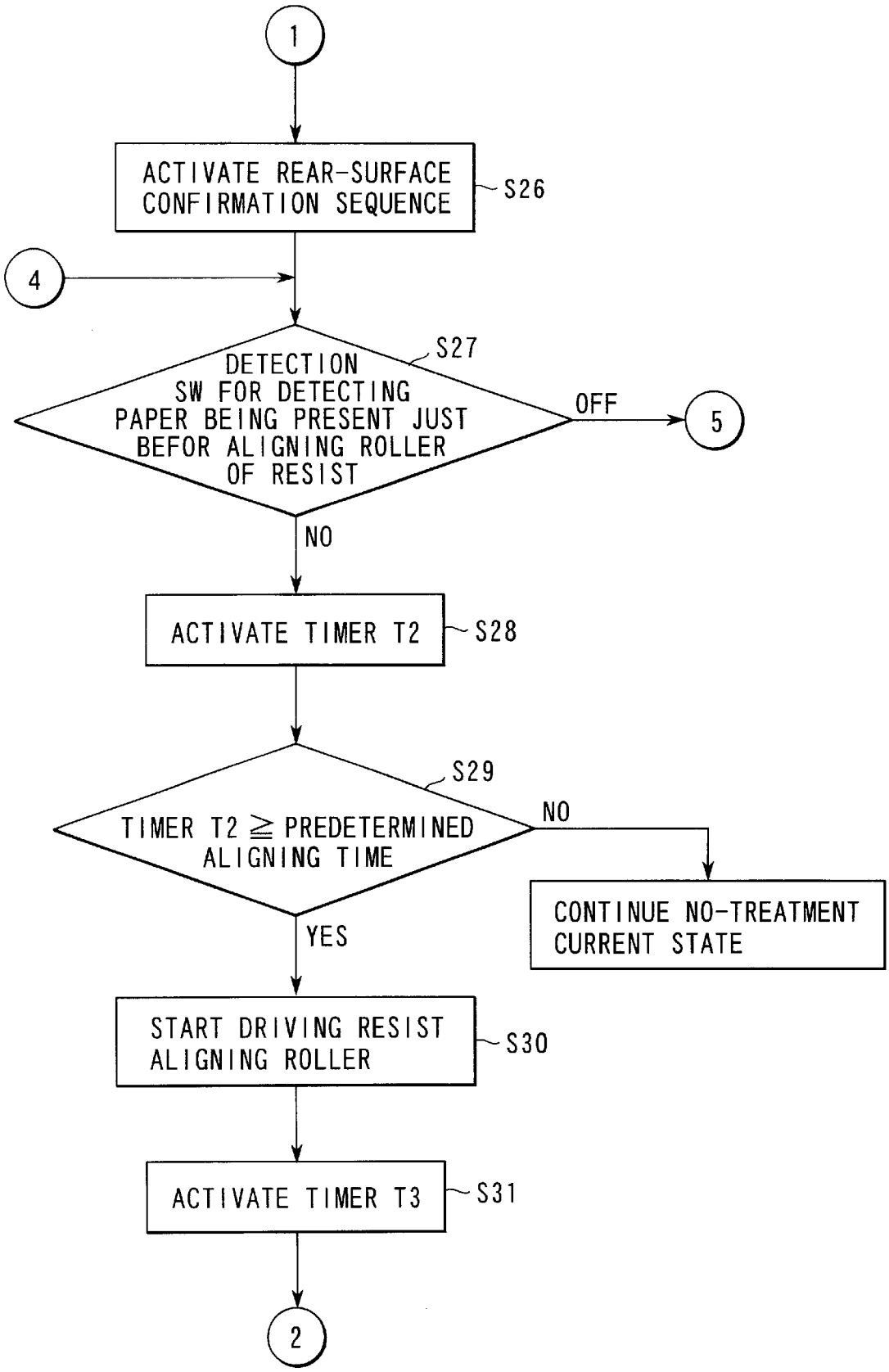
FIG. 10 is a flowchart illustrating a printing operation.
Figure 11:
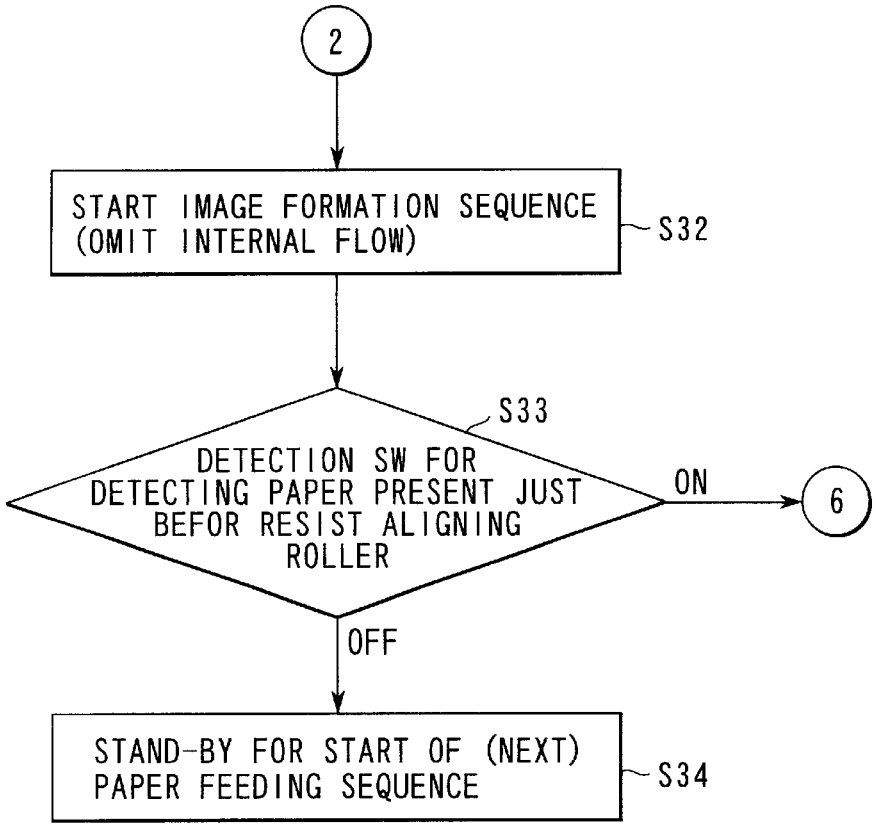
FIG. 11 is a flowchart illustrating a printing operation.

When a printing operation is started, the feeding of paper sheets is started (step S21). Counting from the start of the printing operation, when the timer operates for a time of T1 (step S22), it is checked if the OHP sensor 34 detects an image-transfer object material or not (step S23). When an object material is detected, an identification sequence which identifies if the object sheet is a paper sheet or a transparent sheet is activated (step S24). After a while, it is judged whether it is black and white printing or not (step S25). When it is judged to be the black and white printing, the rear surface confirmation sequence is activated (step S26) as shown in FIG. 10. Subsequently, it is detected as to whether or not there is an operation of a detection switch 62 for detecting a paper sheet immediately before the aligning roller 31 (step S27). When the detection switch 62 is turned on, the timer operates for a time of T2 (step S28). After while, it is judged whether or not the timer activation time T2 is larger than a predetermined aligning time (step S29). When it is judged to be larger, the rotation of the resist aligning roller 31 is started (step S30). Further, when the timer operates for a time of T3 (step S31), the image formation sequence is started (step S32) as shown in FIG. 11. Subsequently, it is detected as to whether or not the detection switch 62 for detecting a paper sheet immediately before the aligning roller 31 (step S27) is turned on. When the detection switch 62 is turned off, the operation stands by for the next paper feeding sequence to be started (step S34).

Figure 12:
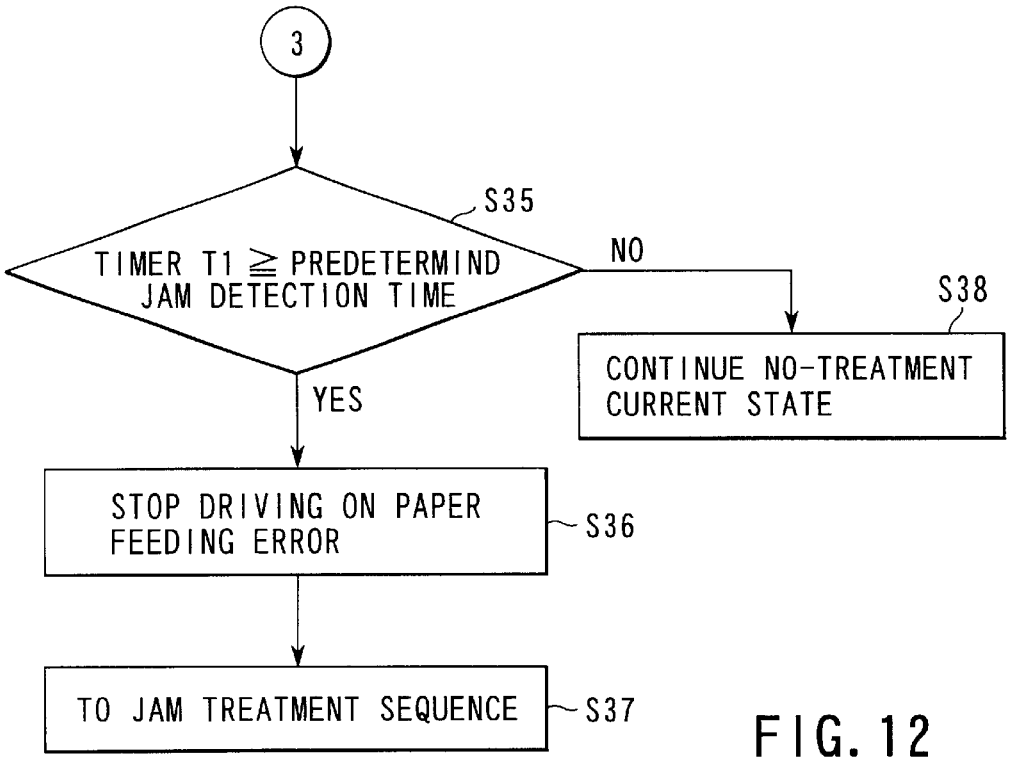
FIG. 12 is a flowchart illustrating a printing operation.

It the step S23, when the sensor output is judged to be off, then as shown in FIG. 12, it is judged whether or not the timer activation time T1 is larger than a predetermined paper jam detection time (step S35). When judged to be larger, it is considered that the feeding of paper sheets has been unsuccessful and the driving of the system is stopped (step S36). Then, the jamming is treated (step S37). In the step S35, the timer activation time T1 is judged to be smaller than the predetermined paper jam detection time, the current status is maintained and continued without any treatment (step S38).

Figure 13:
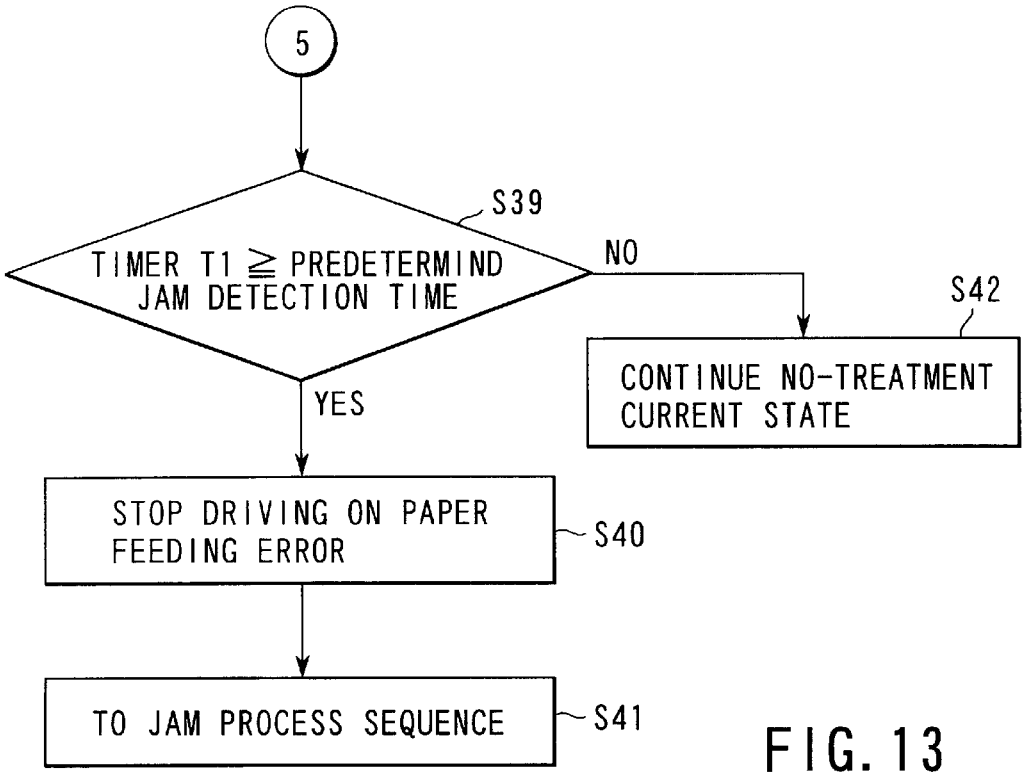
FIG. 13 is a flowchart illustrating a printing operation.

It the step S27, when the sensor output is judged to be off, then as shown in FIG. 13, it is judged whether or not the timer activation time T1 is larger than a predetermined paper jam detection time (step S39). When judged to be larger, it is considered that the feeding of paper sheets has been unsuccessful and the driving of the system is stopped (step S40). Then, the jamming is treated (step S41). In the step S39, the timer activation time T1 is judged to be smaller than the predetermined paper jam detection time, the current status is maintained and continued without any treatment (step S42).

Figure 14:
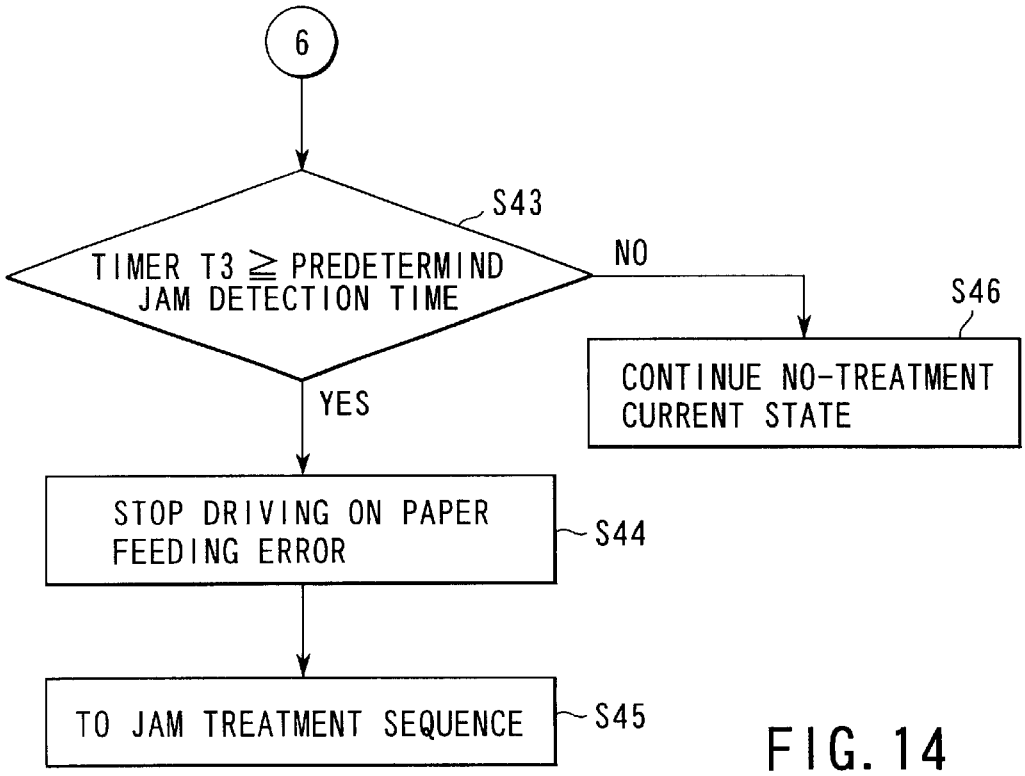
FIG. 14 is a flowchart illustrating a printing operation.

It the step S33, when the sensor output is judged to be on, then as shown in FIG. 14, it is judged whether or not the timer activation time T3 is larger than a predetermined paper jam detection time (step S43). When judged to be larger, it is considered that the feeding of paper sheets has been unsuccessful and the driving of the system is stopped (step S44). Then, the jamming is treated (step S45). In the step S43, the timer activation time T3 is judged to be smaller than the predetermined paper jam detection time, the current status is maintained and continued without any treatment (step S46).

Figure 15:
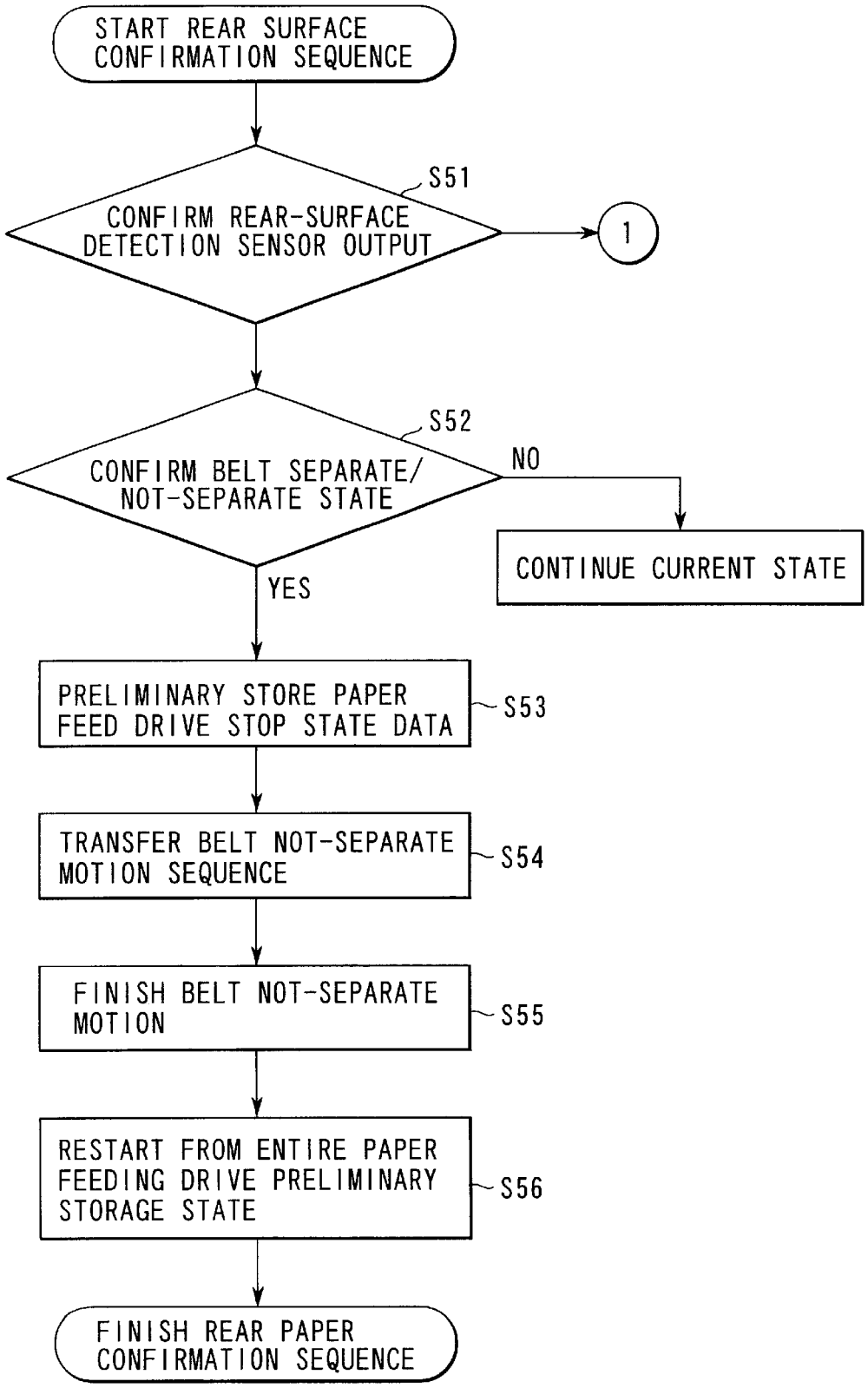
FIG. 15 is a flowchart illustrating a contact-sway operation of the transfer belt, which is operated on the basis of the detection of whether or not an image is present on a rear surface of a sheet.
Figure 16:
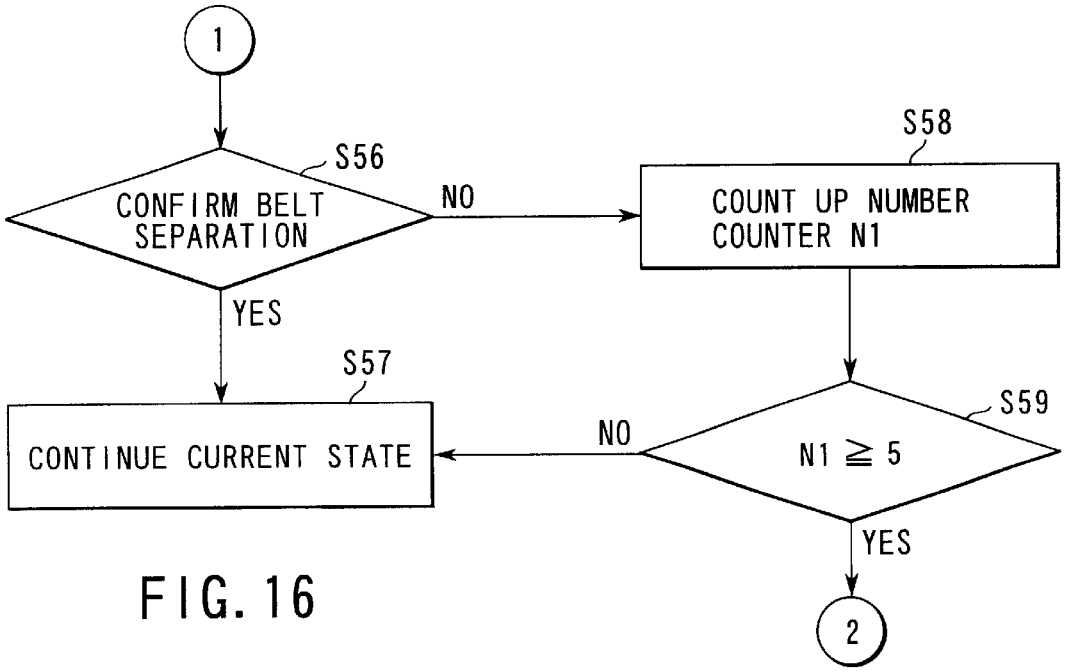
FIG. 16 is a flowchart illustrating a contact-sway operation of the transfer belt, which is operated on the basis of the detection of whether or not an image is present on a rear surface of a sheet.

FIG. 15 is a flowchart illustrating the operation (rear surface confirmation sequence) in accordance with the presence/absence of the image on the rear surface of a sheet.

When the rear surface confirmation sequence is started, it is judged whether or not there is an output from the detection sensor 61 (step S51). When it is judged that there is a detection output from the detection sensor 61, whether or not the transfer belt 10 is separated from the photosensitive drums is judged (step S52). When it is judged that the transfer belt 10 is separated from the photosensitive drums, the driving of the paper feeding unit is stopped, and at the same time, the data on the state is preliminary stored (step S53). Then, when the transfer belt 10 is moved obliquely upwards (step S54), so as to be brought into contact with all of the photosensitive drums (step S55), the paper feeding unit is re-started from the preliminary storage state (step S56), the rear surface confirmation sequence is completed.

Figure 17:
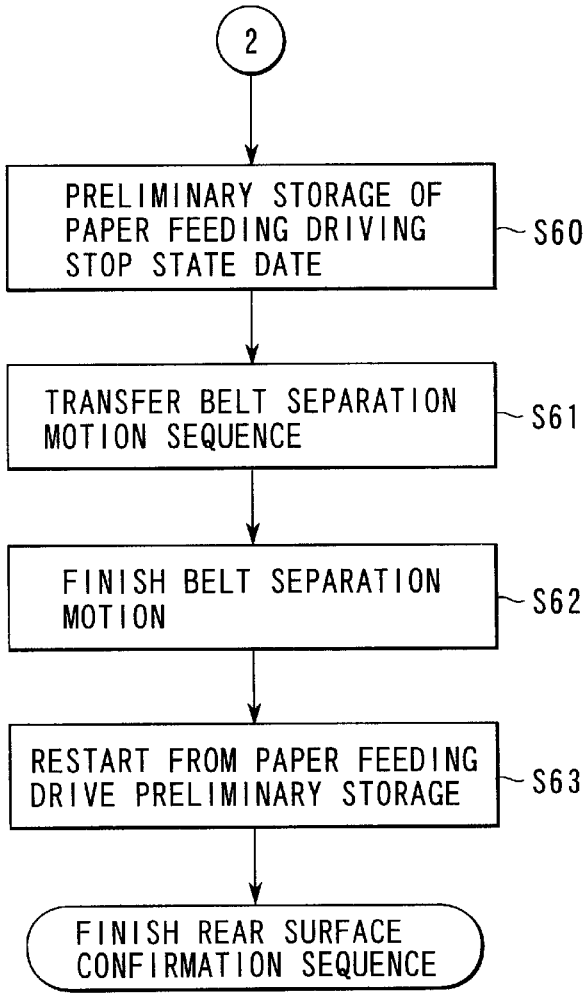
FIG. 17 is a flowchart illustrating a contact-sway operation of the transfer belt, which is operated on the basis of the detection of whether or not an image is present on a rear surface of a sheet.
Figure 18:
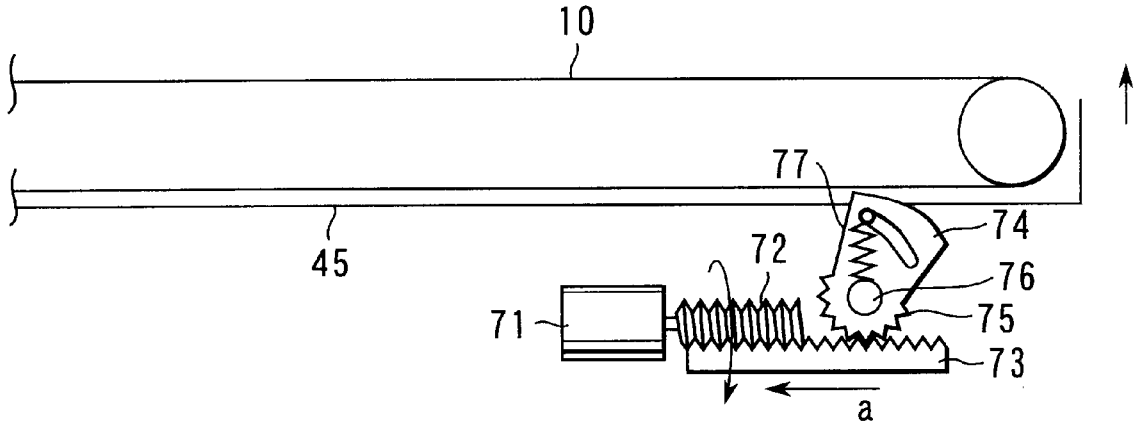
FIG. 18 is a diagram showing the second example of the contact-separation mechanism of the transfer belt.
Figure 19:
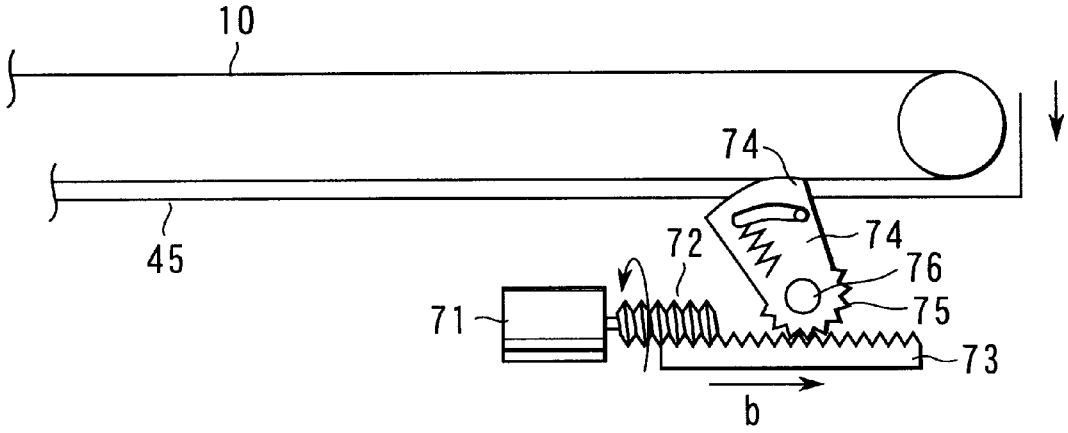
FIG. 19 is a diagram showing the operation of the contact-separation mechanism shown in FIG. 18.

In the step S51, if the detection output from the detection sensor 61 is not confirmed, it is judged whether or not the transfer belt 10 is separated from the photosensitive drums (step S56). When judged to be separated, the current status is maintained and continued (step S57). When judged to be not separated, a sheet number counter counts up the number of sheet thus detected (step S58). Then, it is judged whether or not the counted number N1 is larger than 5 (step S59). When the counted number N1 is judged to be larger than 5, as shown in FIG. 17, the driving of the entire paper feeding system is stopped, and the data on the state is preliminary stored (step S60). Then, the sequence for separating the transfer belt 10 is started (step S61). When the sequence for separating the transfer belt 10 from the photosensitive drums is finished (step S62) the paper feeding unit is re-started from the preliminary storage state (step S56), and the rear surface confirmation sequence is thus completed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a plurality of image forming means for forming developer images of different colors, said plurality of image forming means including a plurality of image carriers;

transfer means for conveying an image transfer medium to the plurality of image carriers, and transferring the developer images formed by said plurality of developer image forming means on the image transfer medium;

identification means for identifying developer image forming means necessary for forming a predetermined image;

switch means for switching, in accordance with an identification result of said identification means, between a first contact state where said transfer means is brought into contact with a part of said plurality of developer image forming means and a second contact state where said transfer means is brought into contact will all of said plurality of developer image forming means;

mode selection means for selecting either one of a first transfer mode for transferring an image on only one side of the image transfer medium, and a second transfer mode for transferring an image on both sides of the image transfer medium; and control means for controlling to set the contact state between said transfer means and said plurality of developer image forming means to the second contact state regardless of the identification result of the identification means in the case where the mode designated by said mode selection means is the second transfer mode.

2. An image forming apparatus according to claim 1, wherein said identification means identifies if a mode is for forming a multi-color image or a monochrome image.

3. An image forming apparatus according to claim 2, wherein when said identification means identifies that the mode is for a monochrome image forming mode and the first transfer mode is selected, the contact state between said transfer means and said plurality of developer image forming means is set to the first contact state.

4. An image forming apparatus according to claim 2, wherein when said identification means identifies that the mode is for a monochrome image forming mode and the second transfer mode is selected, the contact state between said transfer means and said plurality of developer image forming means is set to the second contact state.

5. An image forming apparatus according to claim 4, wherein when said identification means identifies that the mode is for a monochrome image forming mode and the second transfer mode is selected, said transfer means and said plurality of developer image forming means are set to the first contact state while forming an image on one side of the image transfer medium, and they are set to the second contact state while forming an image on another side of the image transfer medium.

6. An image forming apparatus according to claim 2, wherein when said identification means identifies that the mode is for a multi-color image forming mode, the contact state between said transfer means and said plurality of developer image forming means is set to the second contact state.

7. An image forming apparatus according to claim 1, wherein said switch means has an actuator which is electrically driven to operate in one direction or an opposite direction, thus bringing the transfer means into contact with an image carrier or separating it therefrom.

8. An image forming apparatus according to claim 1, wherein said switch means has an actuator which is electrically driven to operate in one direction or an opposite direction, thus bringing said transfer means into contact with an image forming means or separating it therefrom.

9. An image forming apparatus according to claim 1, further comprising:

feeding means for feeding the image transfer medium to said transfer means;

aligning means for aligning said image transfer medium fed from the feeding means, and sending it to said transfer means; and sheet-like pressing member for pressing the image transfer medium fed from the aligning means to said transfer means.

10. An image forming apparatus according to claim 9, wherein said pressing member is made flat and has an elasticity.

11. An image forming apparatus comprising:

a plurality of image forming units for forming images on image carriers;

a transfer unit for conveying an image transfer medium to the image carriers of said plurality of image forming units, and transferring the images on the image carriers on one surface side of the image transfer medium;

a feeder unit for feeding the image transfer medium to said transfer unit;

a contact-separation mechanism for bringing said transfer unit in contact with all of said plurality of image forming units in a multi-color image forming mode, and for bringing said transfer unit in contact with image carrier of some of said plurality of image forming units, in a monochrome image forming mode;

a judgment unit for judging whether or not an image is formed on an other surface side of the image transfer medium fed to said feeder unit; and a control unit for controlling an operation of said contact-separation mechanism such as to bring said transfer unit into contact with all of the image carriers of said plurality of image forming units when said judgment unit judges that an image is formed on the other surface side of the image transfer medium in a single color image forming mode.

12. An image forming apparatus according to claim 11, wherein said judgment unit includes an optical sensor for optically detecting an image formed on the image transfer medium.

13. An image forming method of an image forming apparatus having a plurality of image forming means for forming developer images of different colors on an image transfer medium, and transfer means for transferring the developer images formed by said plurality of developer image forming means on the image transfer medium, said method comprising:

a first identification step for identifying if a mode is for forming a multi-color image or a monochrome image;

a second identification step for identifying a first transfer mode where an image is transferred on only one side of the image transfer medium or a second transfer mode where an image is transferred on both sides of the image transfer medium; and a switching step for switching, in accordance with identification results of said first and second identification steps, contact states between said transfer means and said plurality of developer image forming means, wherein when it is identified in the first identification step that the mode is for forming a monochrome image, and identified in the second identification step that the mode is the second transfer mode, said transfer means is brought into contact will all of said plurality of developer image forming means in the switching step.

14. An image forming method according to claim 13, wherein when it is identified in the first identification step that the mode is for forming a monochrome image, and identified in the second identification step that the mode is the first transfer mode, said transfer means is brought into contact with some of said plurality of developer image forming means in the switching step.

15. An image forming method according to claim 13, wherein when it is identified in the first identification step that the mode is for forming a multi-color image, said transfer means is brought into contact with all of said plurality of developer image forming means in the switching step.

16. An image forming method of an image forming apparatus having a plurality of image forming means for forming developer images of different colors on an image transfer medium, and transfer means for transferring the developer images formed by said plurality of developer image forming means on the image transfer medium, said method comprising:

a first identification step for identifying if a mode is for forming a multi-color image or a monochrome image;

a second identification step for identifying a first transfer mode where an image is transferred on only one side of the image transfer medium or a second transfer mode where an image is transferred on both sides of the image transfer medium; and a switching step for switching, in accordance with identification results of said first and second identification steps, contact states between said transfer means and said plurality of developer image forming means, wherein when it is identified in the first identification step that the mode is for forming a monochrome image, and identified in the second identification step that the mode is the first transfer mode, said transfer means is brought into contact with some of said plurality of developer image forming means in the switching step while an image is formed on one side of the image transfer medium, and said transfer means is brought into contact with all of said plurality of developer image forming means in the switching step while an image is formed on another side of the image transfer medium, in the switching step.

17. An image forming apparatus comprising:

a plurality of image forming devices which form developer images of different colors;

a transfer device which conveys an image transfer medium to image carriers of said plurality of image forming devices, and transfers the developer image forming devices onto the image transfer medium;

an identification device which identifies a developer image forming device necessary for forming a predetermined image;

a switch device which switches, in accordance with an identification result of said identification device between a first contact state where said transfer device is brought into contact with a part of said plurality of developer image forming devices and a second contact state where said transfer device is brought into contact with all of said plurality of developer image forming devices;

a mode selection device which selects either one of a first transfer mode for transferring an image onto only one side of the image transfer medium, and a second transfer mode for transferring an image onto both sides of the image transfer medium; and a control device which controls to set the contact state between said transfer device and said plurality of developer image forming devices to the second contact state regardless of the identification result or the identification device in the case where the mode designated by said mode selection device is the second transfer mode.

* * * * *